US006119638A

United States Patent [19]

Kennedy

[11] Patent Number: 6,119,638

[45] Date of Patent: Sep. 19, 2000

[54] DIESEL POWERED GENERATOR COOLING-WATER PUMP

[76] Inventor: Gino W. Kennedy, 800 SE. 7th Ave., Pompano Beach, Fla. 33060

[21] Appl. No.: 09/078,205

[22] Filed: May 13, 1998

[51] Int. Cl.[7] ..... F01P 5/10

[52] U.S. Cl. ..... 123/41.47; 123/185.12; 123/41.46

[58] Field of Search ..... 123/41.47, 198 C, 123/41.46, 2, 3, 185.12

[56] References Cited

U.S. PATENT DOCUMENTS

| | | | |
|---|---|---|---|
| 3,927,954 | 12/1975 | Walker | 12/41.47 |
| 4,033,282 | 7/1977 | Pichl | 123/41.47 |
| 4,134,596 | 1/1979 | Kawai et al. | 123/41.47 |
| 4,155,333 | 5/1979 | Maggiorana | 123/41.47 |
| 4,565,534 | 1/1986 | Bland | 12/41.47 |
| 4,643,135 | 2/1987 | Unsche | 123/41.47 |
| 5,095,871 | 3/1992 | Mezger | 123/41.47 |
| 5,415,134 | 5/1995 | Stewart, Jr. | 123/41.47 |

*Primary Examiner*—Willis R. Wolfe
*Assistant Examiner*—Jason Benton
*Attorney, Agent, or Firm*—McHale & Slavin

[57] ABSTRACT

The instant invention is a modification to a diesel engine powered generator set to provide raw cooling-water by utilizing the engines hand crank shaft to drive a self-priming impeller-type pump in a marine setting.

5 Claims, 4 Drawing Sheets

DIESEL POWERED GENERATOR COOLING-WATER PUMP

FIELD OF THE INVENTION

This invention relates to small diesel engine generator sets for use in boats and, in particular, to a modification of the diesel engine for providing cooling-water to the engine.

BACKGROUND OF THE INVENTION

In the marine industry, a generator set is used for the generation of A.C. electricity when a marine vessel is underway, moored, or anchored. The generator set allows all modern conveniences to be operated on the marine vessel such as air-conditioning, refrigerator, stove, A.C. lights, electric water heaters and so forth.

Small generator sets, used on small boats, are typically powered by a gas engine which present unique problems that can make their use dangerous. The use of gasoline is a volatile fuel which leads to handling and exhaust concerns. Large generator sets employ diesel engines, which are superior to gasoline engines for economy, and are typically found on larger boats due to their size and weight. Ironically, the need for fuel efficient engines is needed by the smaller boats which have limited fuel capacities.

Recently, generator set manufacturers have been able to adapt small diesel engines for use in boats, even if the boats employ gasoline engines for propulsion. For instance, the engine manufacturer known as Kubota builds a horizontal, 4-cycle diesel engine having a single cylinder that produces 7 HP. The applicant has adopted the engine to a generator wherein the combination is capable of producing 3500 Watts while drawing about 2/10 gallons of diesel fuel per hour. The combination disclosed in a previous patent application by the Applicant having U.S. Ser. No. 08/808,880, the contents of which is incorporated herein by reference. The minimal fuel requirement allows even small boats to install a generator and fuel tank. The entire engine and generator requires a space less than 15 inches wide, 15 inches tall, and 28 inches long.

A requirement with any engine that operates in a confined area is the need for cooling. Boats are unique in that cooling may be obtained from the same water that the boat is driven upon. If the water is high in salinity, the diesel engine should also be freshwater cooled. Freshwater cooled means that the engine incorporates a closed circulating coolant, e.g. a mixture of water and an ethylene-glycol type cooling fluid. The cooling fluid interfaces with a liquid-liquid heat exchange device, which is supplied with constantly circulating water, normally designated "raw" cooling-water, from the sea, river, etc., thereby maintaining the engine at a safe operating temperature.

Maintenance of an adequate supply of circulating water is performed by a number of methods, such as an internal pump, a motor driven pump, or an external pump operated on either D.C. power derived from the vessel's batteries, or A.C. power derived from the output of the generator.

The natural position of a motor driven pump would be along an extension from the drive shaft that rotates the generator. However, as previously mentioned, small boats have limited space and the placement of a motor driven pump to the drive shaft will cause an increase in the width of the generator set, which may make it unacceptable for many such boats. In addition, the drive shaft used for rotation of the generator is always positioned in the rear of the generator set as it requires no maintenance and its rotation can be dangerous if exposed. For this reason, the drive portion of a generator set, such as the Kubota, is placed against the hull of a boat with all items of maintenance located along the front of the generator set.

Thus, placement of a motor driven pump along the drive shaft not only increases the width of the generator set but also positions a pump, which must be accessible, in a most unaccessible position. It should be noted that the raw water pump on any engine is subject to normal wear and must be repaired or replaced as needed. If the boat is driven in gritty water, this pump may be replaced frequently.

For the above reasons, diesel powered motors used in small boats typically have an external pump mounted remotely from the generator set. However, this type of operation also presents problems. If the boat is equipped with components such as marine navigational equipment, shower, head, stereo, cabin lights, DC refrigerator, bilge pumps, etc., it is often possible to draw the battery(ies) down to dangerously low levels by adding the constant operation of a cooling-water pump to its load. If the boat owner chooses to operate the cooling-water pump via an A.C. motor, the potential of creating a lethal situation arises. High water in the bilge coupled with the presence of A.C. voltages in the 110–120 volt range can create an environment where electrocution becomes a real possibility. In addition, the use of an A.C. pump requires the generation of electricity, which may not occur for 10 or more seconds after the start of the pump.

Thus, what is needed in the field is a means of providing adequate and dependable flow of raw cooling-water without incurring an undesirable drain on the boat's D.C. power resources, causing a perilous condition due to the presence of A.C. power, or adding to the size of the generator set.

SUMMARY OF THE INVENTION

The present invention teaches a novel means of providing an adequate and dependable flow of raw cooling-water to a diesel marine genset without incurring an undesirable drain on the boat's D.C. power resources or causing a perilous condition due to the presence of A.C. power.

In particular, the invention addresses the use of a hand crane spinal. Many small diesel power plants, are provided with means to enable manual starting. Such means are often in the form of a handle adapted to be in direct communication with a drive gear which is further adapted to engage and rotate the engine's flywheel when rotated by the operator. This rotation creates the necessary conditions of compression, air/fuel ratio, etc. within the engine to initiate the combustion of fuel and thereby initiate the well-known diesel combustion process, after which the engine can continue to run on its own.

In marine installations, the use of this feature is impractical since the generator set is generally situated below deck and is positioned in such a way that it would be virtually impossible to start such an engine by use of a hand-crank. Thus, such gensets are modified to incorporate electrical starter motors and do not utilize the hand-cranking feature.

The present invention solves the problem of raw water pumping by utilizing the already provided direct communication between the drive gear and the engine's flywheel as a means of deriving rotational power from the engine. This rotational power is utilized to drive a self-priming impeller-type pump which provides an immediate, constant and reliable source of raw cooling-water simultaneously with the operation of the engine. In the instant invention the preferred horizontal KUBOTA engine is modified by machining of the housing that surrounds the hand crank shaft so as to provide for attachment of a drive shaft gear thereto. Additionally, a bracket is fashioned to support the pump in such a way that the pump does not increase the overall width of the device. Prior art attempts to add an auxiliary pump to the output shaft of such engines resulted in the engine compartment having to accommodate an additional 4" of depth. Even if the engine compartment could accommodate the depth, the pump may not be accessible for service.

Thus, it is an object of the present invention to provide an adequate and dependable flow of raw cooling-water to the diesel engine power plant of a marine genset without necessitating use of the boat's D.C. power resources or utilizing A.C. power.

It is a further object of the invention to provide a source of raw cooling-water to a diesel engine power plant by utilizing the engine to drive a self-priming impeller-type pump.

It is yet another object of the present invention to add a raw water pumping assembly to an existing power generating assembly which is of a compact size and does not protrude from the assembly in such a way as to increase its profile or footprint.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE PREFERRED EMBODIMENT(S)

Figure 1:
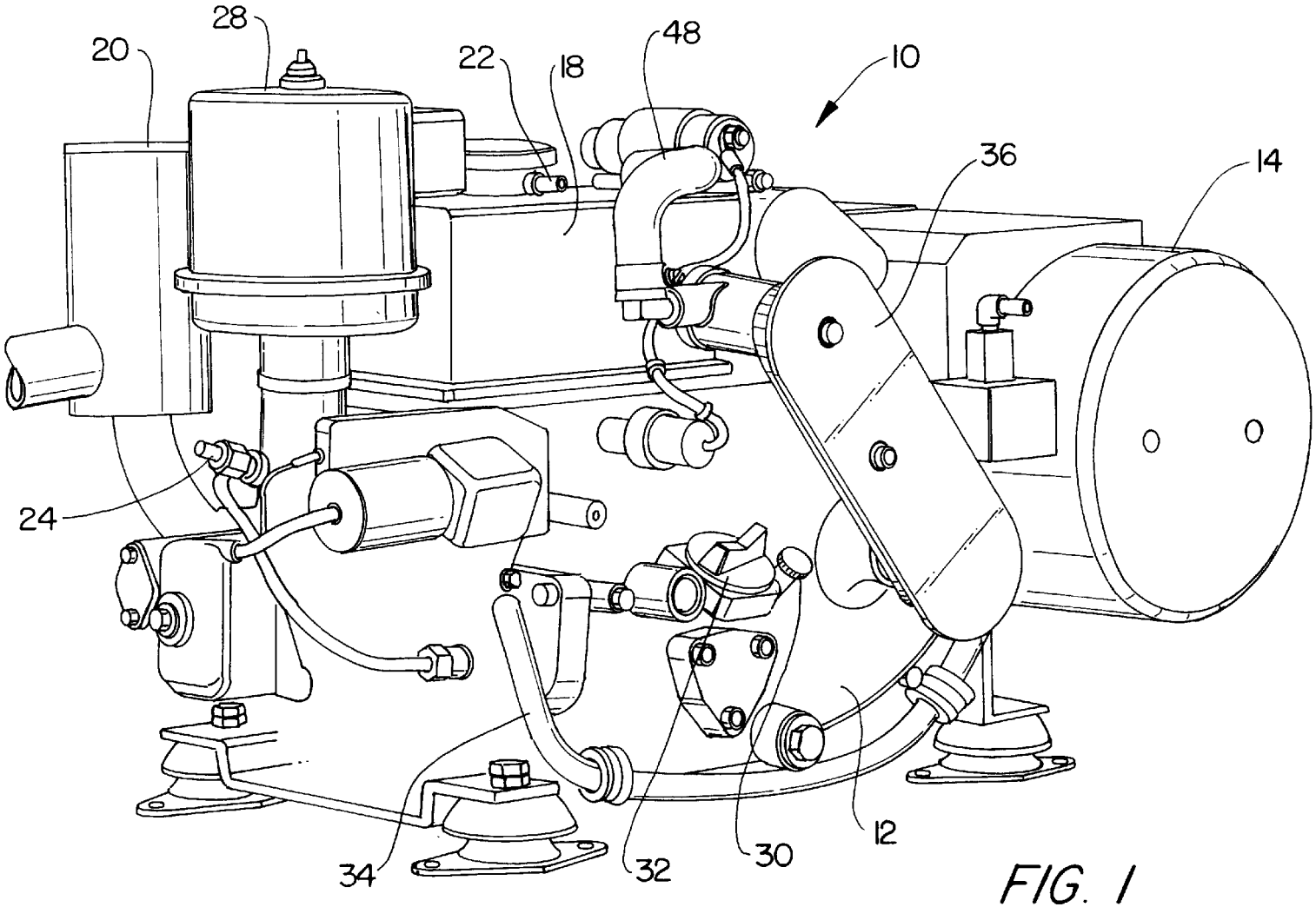
FIG. 1 is a perspective view of the diesel powered marine generating assembly of the instant invention.
Figure 2:
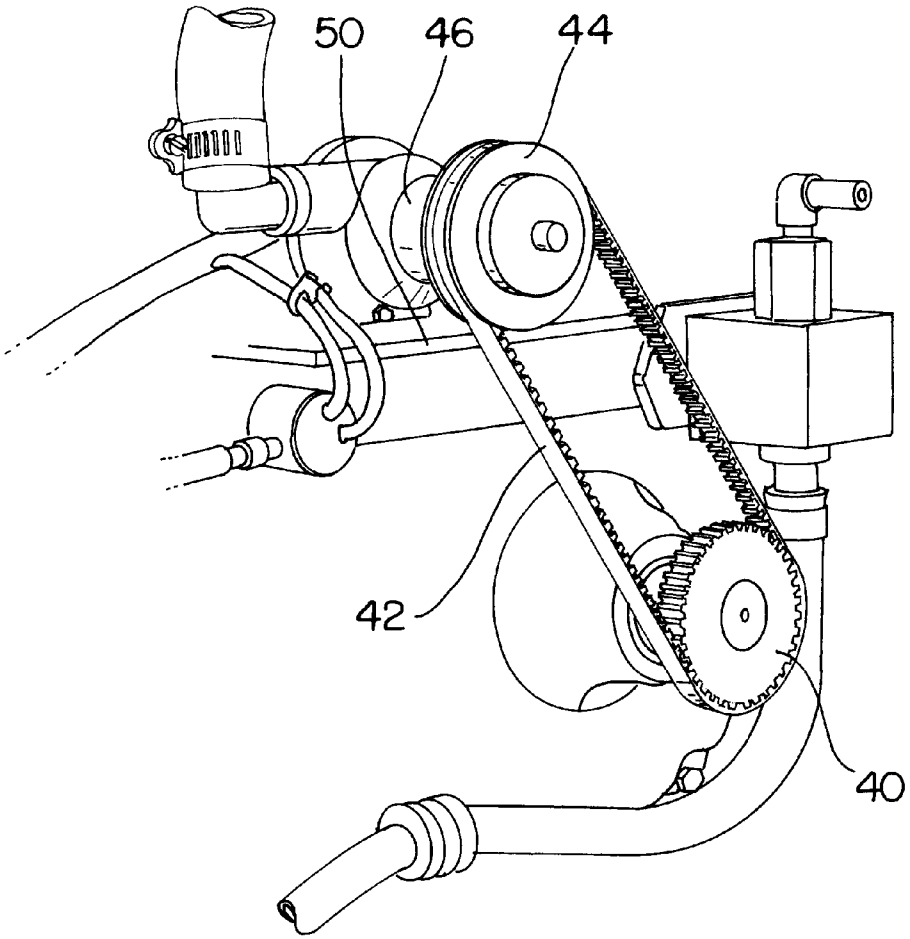
FIG. 2 is a perspective view of the diesel powered marine generating assembly of the instant invention with the protective drive-belt cover removed.

Referring to the Figures, as shown in FIG. 1, the device 10 generally comprises a diesel engine 12 and an electrical generator 14. As best seen in FIG. 2, the engine has a hand-crank power output which is adapted to rotate the drive shaft of the impeller-type pump, and which, in a most preferred embodiment, has been modified by attachment thereto of a gear-driven belt assembly comprising an external hand-crank drive shaft gear 40 which transfers power via an endless-loop belt 42 to the drive wheel 44 of the self-priming impeller type pump 46. During normal operation, the gear and belt assembly is protected by a drive-belt cover 36 (FIG. 1).

In operation, the suction created by the pump causes raw water to first be drawn through a thru-hull fitting positioned at the bottom of the vessel, then through a strainer and finally through a conduit which communicates with the suction side of the pump. The output side of the pump communicates with a conduit 48 which, in a preferred embodiment, forces water-through a heat exchanger 18, preferably a cupro-nickel fresh water heat exchanger, and finally through a water cooled exhaust mixer 20, from which the water is returned to the source. The heat exchanger carries the raw water on one side and circulates a fresh water coolant, preferably a water/ethylene glycol mixture, on the other side. A coolant overflow reservoir, not shown, may be provided and communicates via a conduit with expansion outlet 22.

The engine, which in a preferred embodiment is a fully fresh water marinized horizontal KUBOTA diesel engine, may be ignition protected for use in gasoline environments. The preferred engine is a 1 cylinder, 4 cycle engine having 7 SAE horsepower at 2800 rpm. The engine contains standard components such as an injector 24, a throttle solenoid 26, a spark arrestor 28, an oil dipstick 30, an oil filler plug 32 and a high pressure fuel line 34. The horizontal KUBOTA engine is modified by machining of the housing that surrounds the hand crank shaft so as to provide for attachment of the drive shaft gear 40. A bracket 50 (FIG. 2) is fashioned to support the pump in such a way that the pump does not increase the overall width of the device. The preferred pump is a Johnson Model F35B-8 which is rated at 3 GPM at 1750 RPM.

Figure 3:
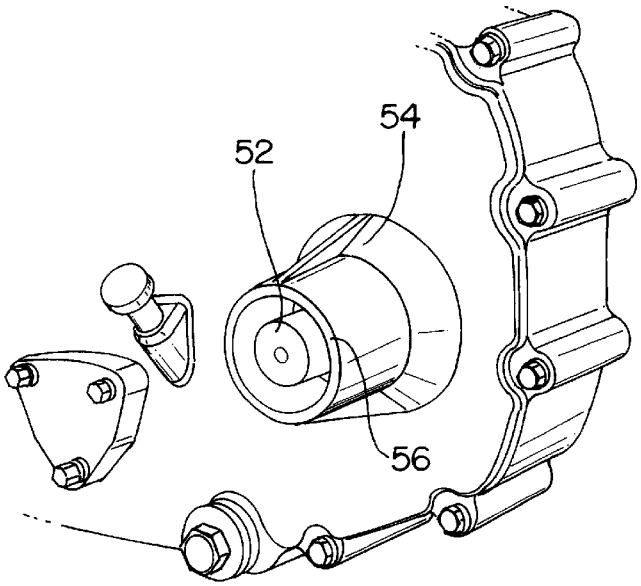
FIG. 3 is a perspective view of the prior art engine without the hand-crank drive shaft modifications as taught by the instant invention.
Figure 3A:
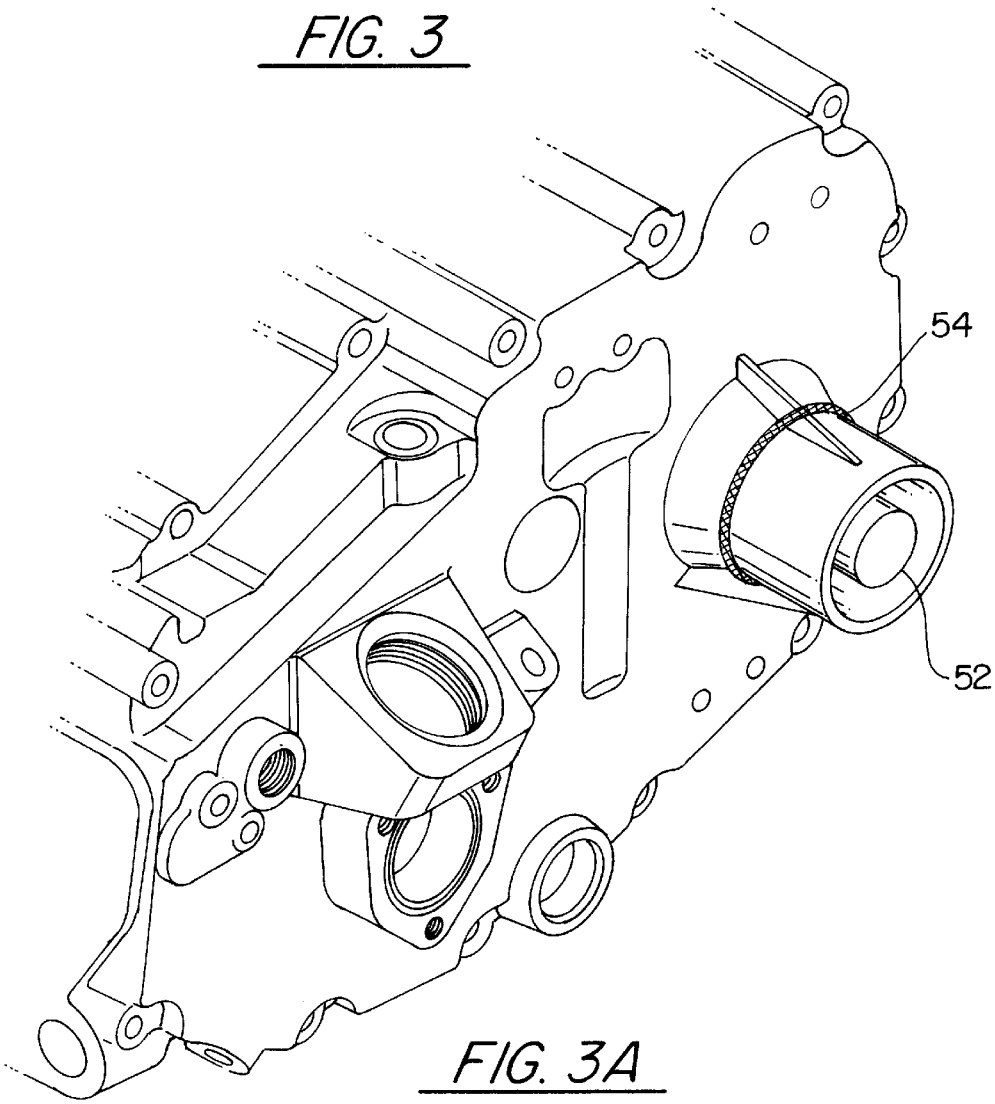
Figure 3B:
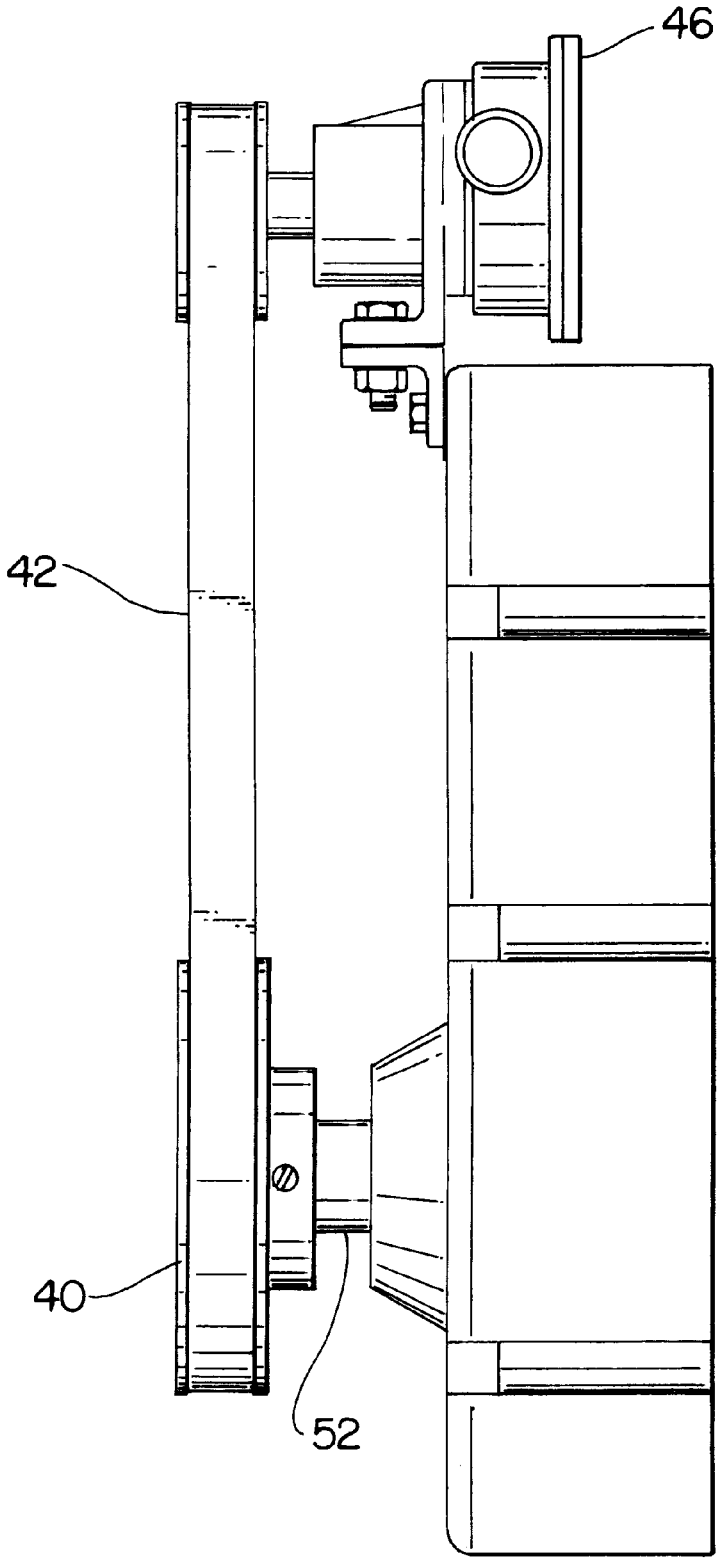

Referring to FIG. 3, the prior art engine is shown absent the modifications provided by the instant invention. In this illustration, hand-crank shaft 52 is shown shield by the cover 54. The end 56 of the cover is removed to allow the coupling of the shaft gear, referred to as numeral 40 in the previous illustrations.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. In a diesel operated generator set for a marine application, said generator set comprising a diesel engine having a generator secured thereto and operatively associated therewith, said diesel engine having an integral drive shaft for hand-cranking of said engine, the improvement comprising: a self-priming cooling-water circulation pump, said pump being in rotational attachment with the hand-crank drive shaft and adjacent thereto; whereby the rotational power of the engine provides rotation of the self-priming cooling-water circulation pump and thereby provides the engine with an instantaneous flow of cooling-water.

2. The generator set according to claim 1, further including a heat exchanger adapted to receive said flow of cooling-water and thereby provide indirect cooling of said engine.

3. The generator set according to claim 1 or 2 further including a gear driven belt assembly, said assembly containing an external gear attached to the hand-crank drive shaft, an impeller pump drive wheel and an endless-loop belt, said assembly being adapted to transfer the rotational power from the external hand-crank drive shaft gear to the drive wheel of the pump via the endless-loop belt.

4. The generator set according to claim 1 wherein said diesel engine is manufactured by Kubota.

5. The generator set according to claim 1 wherein said hand-crank drive shaft includes a housing adapted to allow securement of said circulation pump.

* * * * *